US005128012A

United States Patent [19]

Olsen

[11] Patent Number: 5,128,012

[45] Date of Patent: Jul. 7, 1992

[54] ARRANGEMENT FOR CLOSING THE TOP OF A SODERBERGANODE IN AN ELECTROLYTIC CELL OR PRODUCTION OF ALUMINUM

[75] Inventor: Arnt T. Olsen, Borhaug, Norway

[73] Assignee: Elkem Aluminium ANS, Norway

[21] Appl. No.: 675,501

[22] Filed: Mar. 26, 1991

[30] Foreign Application Priority Data

May 7, 1990 [NO] Norway ..... 902000

[51] Int. Cl.[5] ..... C25C 3/06; C25C 3/12; H05B 7/094; H05B 7/12

[52] U.S. Cl. ..... 204/245; 204/247; 204/279; 204/294; 373/89; 373/95; 373/97

[58] Field of Search ..... 204/294, 279, 247, 245, 204/243 R-244, 246; 373/89, 97, 94-96

[56] References Cited

U.S. PATENT DOCUMENTS

| | | | |
|---|---|---|---|
| 2,822,328 | 2/1958 | Walker | 373/89 X |
| 2,825,690 | 3/1958 | Ferrand | 204/247 X |
| 3,709,506 | 1/1973 | Beerman | 373/95 X |
| 3,945,906 | 3/1976 | Givens | 373/97 X |
| 4,756,004 | 7/1988 | Stanley et al. | 373/89 |

FOREIGN PATENT DOCUMENTS

| | | | |
|---|---|---|---|
| 193084 | 3/1967 | U.S.S.R. | 204/247 |

*Primary Examiner*—Donald R. Valentine
*Attorney, Agent, or Firm*—Lucas & Just

[57] ABSTRACT

The present invention relates to an arrangement for closing the top of a Søderberganode used in an electrolytic cell for production of aluminum. The anode comprises an anode casing and vertical contact bolts for holding and for conducting electric current to the anode. The top of the anode is closed by means of at least one central cover having openings for the contact bolts and at least one side cover which can be opened in order to charge anode paste to the anode.

10 Claims, 6 Drawing Sheets

Figure 1:
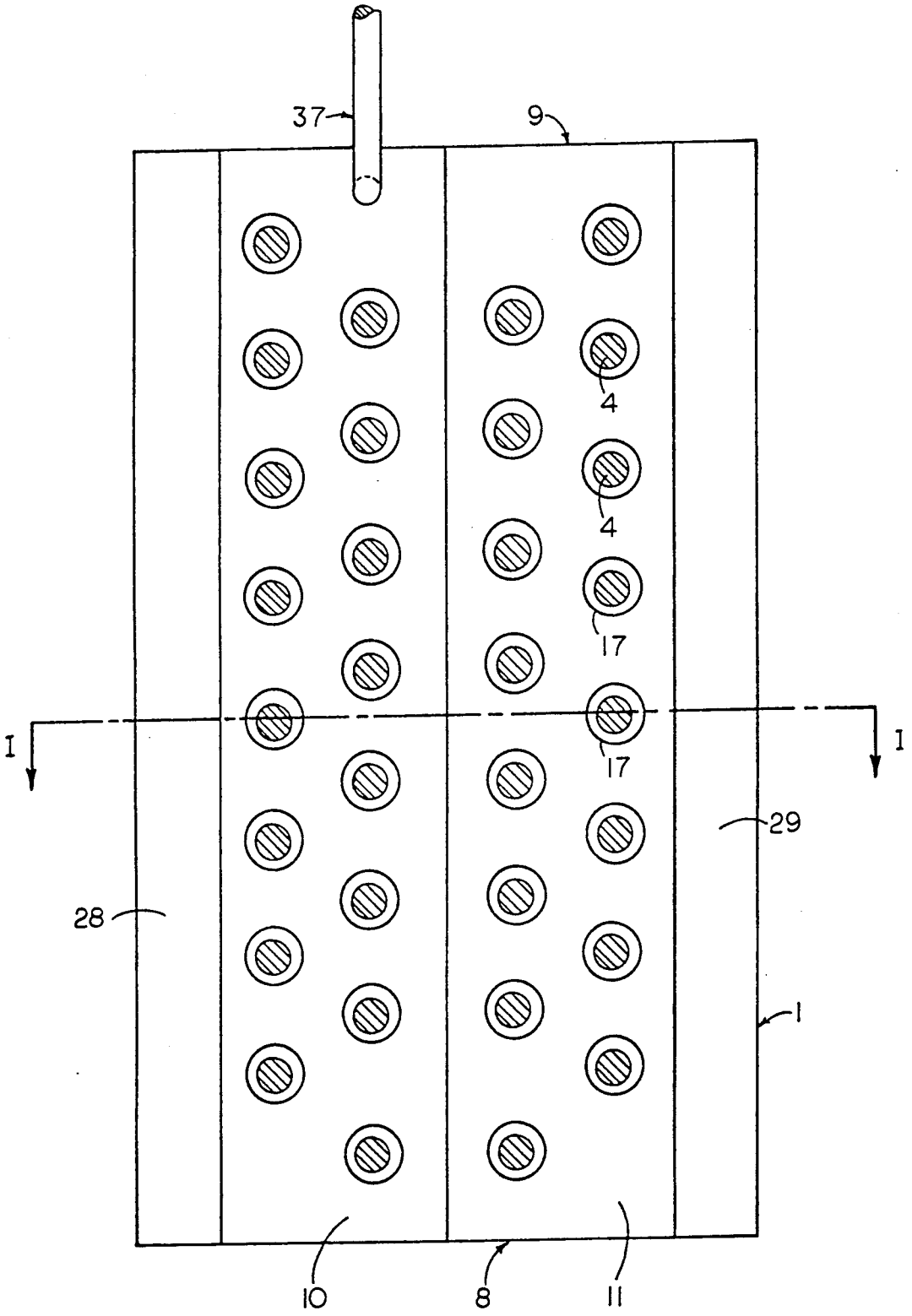

ARRANGEMENT FOR CLOSING THE TOP OF A SODERBERGANODE IN AN ELECTROLYTIC CELL OR PRODUCTION OF ALUMINUM

The present invention relates to an arrangement for closing the top of the anode casing in a Søderberganode for an electrolytic reduction cell for production of aluminium.

The Søderberganode which is used in electrolytic production cells for aluminium comprises a permanent anode casing made from cast iron or steel, which casing surrounds the selfbaking carbon anode. Unbaked carbonaceous electrode paste is charged at intervals to the top of the anode and the unbaked electrode paste is baked to a solid carbon anode by means of the heat generated by the current-supply to anode and by means of heat from the molten electrolytic bath. A main feature of the Soderberganode is thus that the baked anode is moved relatively to the permanent anode casing. Each electrolytic cell is normally equipped with one Soderberganode.

The Søderberganode is suspended by a large number of vertically arranged contact bolts normally made from steel, which also are used for conducting electric operating current to the anode. The lower end of the contact bolts is baked into the anode. The contact bolts are following the downward movement of the anode until their lower ends reaches a predetermined distance from the lower end of the anode. The contact bolts are then pulled out of the anode and placed in a higher position in the anode. By keeping the tip position of the contact bolts in different height positions in the anode, there will always be a sufficient number of bolts having such a tip position that a sufficient holding force is maintained and a good current connection between the bolts and the casing is secured.

The unbaked electrode paste which is charged to the top of the anode evolves gases and volatile organic compounds during the baking process. Some of these gases and volatile compounds, such as for example polyaromatic hydrocarbon compounds (PAH), are harmful to the health and it is therefore a wish to prevent these gases from escaping to the surroundings. Up till now it has been tried to reduce the outlet of gases from the top of the anode by using electrode pastes having a lowest possible content of volatile matter and by keeping the temperature on the top of the anode as low as possible. Even if the emission of gases from the top of the anode in this way have been reduced in recent years, it is not possible by the known technology to reduce emission of harmful gases from the anode top to an acceptable, low level. In Norwegian published patent application No. 136678 it is proposed to close the top of the anode by means of a cover having openings for the contact bolts, and collecting and burning the gases evolved from the anode top. The arrangement according to the Norwegian patent application has, however, a number of disadvantages and drawbacks. This known arrangement has therefore not been put into industrial use. One of the disadvantages of the arrangement described in the Norwegian patent application is that the cover is made in one piece except for necessary openings for charging electrode paste. This makes it necessary to remove and reinstall all the contact bolts in order to put the cover in place. The operation of the electrolytic cell therefore has to be shut down in order to perform this operation. Further the proposed sealing between the contact bolts and the corresponding openings in the cover is done by means of asbestos ropes which will not give a satisfactory sealing, especially when moving the contact bolts up and down. This sealing will therefore not be acceptable for long term operation of an aluminium reduction cell. Finally, it is not shown how the charging of anode paste can take place in such a way that the paste is charged evenly to the complete area of the anode top.

It is an object of the present invention to provide an arrangement for closing the top of the anode casing of a Soderberganode, whereby the disadvantages of the known state of art can be overcome.

Accordingly, the present invention relates to an arrangement for closing the top of a Soderberganode used in connection with electrolytic production of aluminium wherein the anode is equipped with an anode casing and vertical contact bolts for holding and for conducting operation current to the anode and where the top of the anode casing is closed by means of at least one cover having openings for the contact bolts and at least one opening for charging anode paste and at least one off-gas opening, said arrangement being characterized in that the cover comprises a central cover having openings for the contact bolts, said openings having a diameter exceeding the diameter of the contact bolts and where the annular opening between each of the contact bolts and the corresponding openings in the central cover are sealed by means of sealing elements which are gas tight sealed against each of the contact bolts and which are freely flowing on the central cover, and that side covers are arranged between the central cover and the sidewalls of the anode casing, said side covers being rotatably arranged. Preferably, the covers are arranged on three beams longitudinally arranged upon the top of the anode casing, one of the beams being arranged in the center of the anode and the two other beams being arranged on each side of the central beam outside the contact bolts. The central cover is preferably releasably connected to the central beam and the two outer beams by means of screws or bolts.

According to a preferred embodiment of the present invention the central cover section is split into a plurality of cover sections each section comprising openings for at least two, preferably four contact bolts. These cover sections are preferably connected to each other by means of bolts through flanges arranged on each section.

By installing the arrangement according to the present invention the central cover can be installed section by section, and thus only two or optionally four contact bolts have to be withdrawn at the same time in order to install one section of the central cover. The central cover sections can thus be installed without substantial disturbance of the operation of the electrolytic cell. Further, a damaged section of the central cover can be replaced without disturbing the operation of the cell.

The side covers arranged between the outer beams and the sidewalls of the anode casing are rotatably connected to pipes arranged along the outer beams or rotatably connected to pipes arranged along the top of the sidewalls of the anode casing.

In order to ensure a good sealing between the pipes and the outer beams there is preferably arranged a flexible lip along the pipes.

The sealing elements which seal the annular gap between the openings in the center cover and the contact bolts, comprises a horizontal part which ensures sealing against the top of the center cover and sealing members which are pressed against the circumference of the contact bolts. The sealing members can for example comprise elastic rings. In order to ensure an easy and safe entrance of the anode bolts into the sealing elements, the upper part of the sealing elements is conically formed and widens out upwardly and outwardly. In order to prevent the sealing elements from being lifted upwards when the contact bolts are withdrawn in order to be placed in a higher position in the anode, each sealing element is preferably equipped with at least one horizontal arm which is intended to engage with a holding means comprising two brackets connected to the central cover, said brackets holding a metal rod or the like. When a connect bolt is withdrawn the sealing element will be held at rest by the arm or arms of the holding means. In order to prevent damage on the center cover or the sealing elements, the holding means are made in such a way that if the force on the holding means exceeds a preset value, the rod will break.

Finally the arrangement according to the present invention is equipped with at least one outlet opening for gases which evolve during baking of the anode paste. These gases are forwarded to a conventional gas cleaning apparatus for cleaning the gas before it is let out to the environment.

During operation of electrolytic cells equipped with the arrangement according to the present invention, the gas pressure below the covers is kept below the atmospheric pressure. This ensures that gas from the anode top will not flow into the environment around the cells.

The side covers can be rotated from a closed position to an open position either manually or automatically. It is only necessary to open the side casings for changing anode paste and for inspection of the top of the anode.

The arrangement according to the present invention ensures a good sealing between the top of the anode in Søderberganodes which are used for production of aluminium. The arrangement according to the present invention can be installed on existing anodes in a simple way without substantially disturbing the operation of the electrolytic cells.

Figure 2:
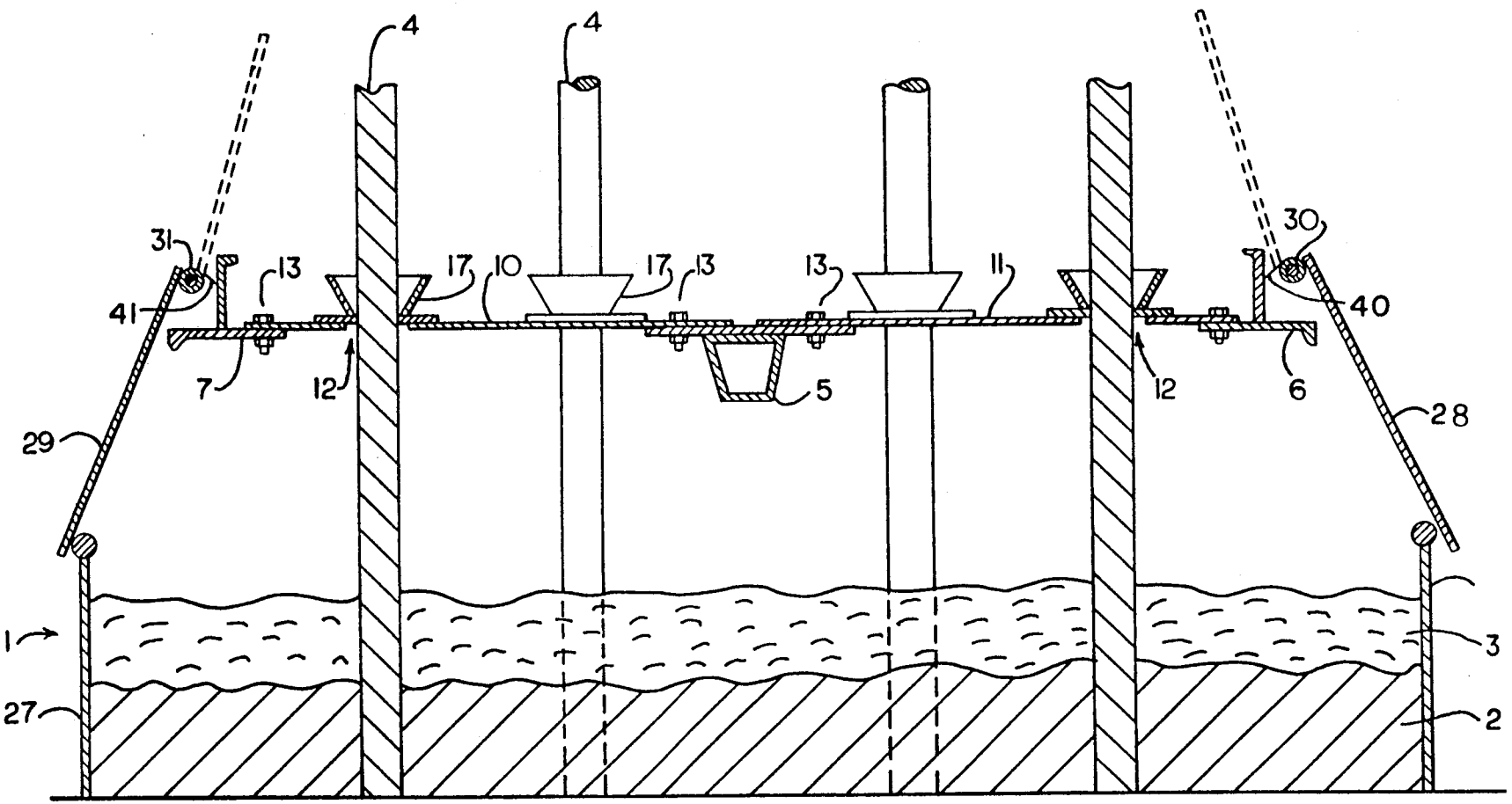
Figure 3:
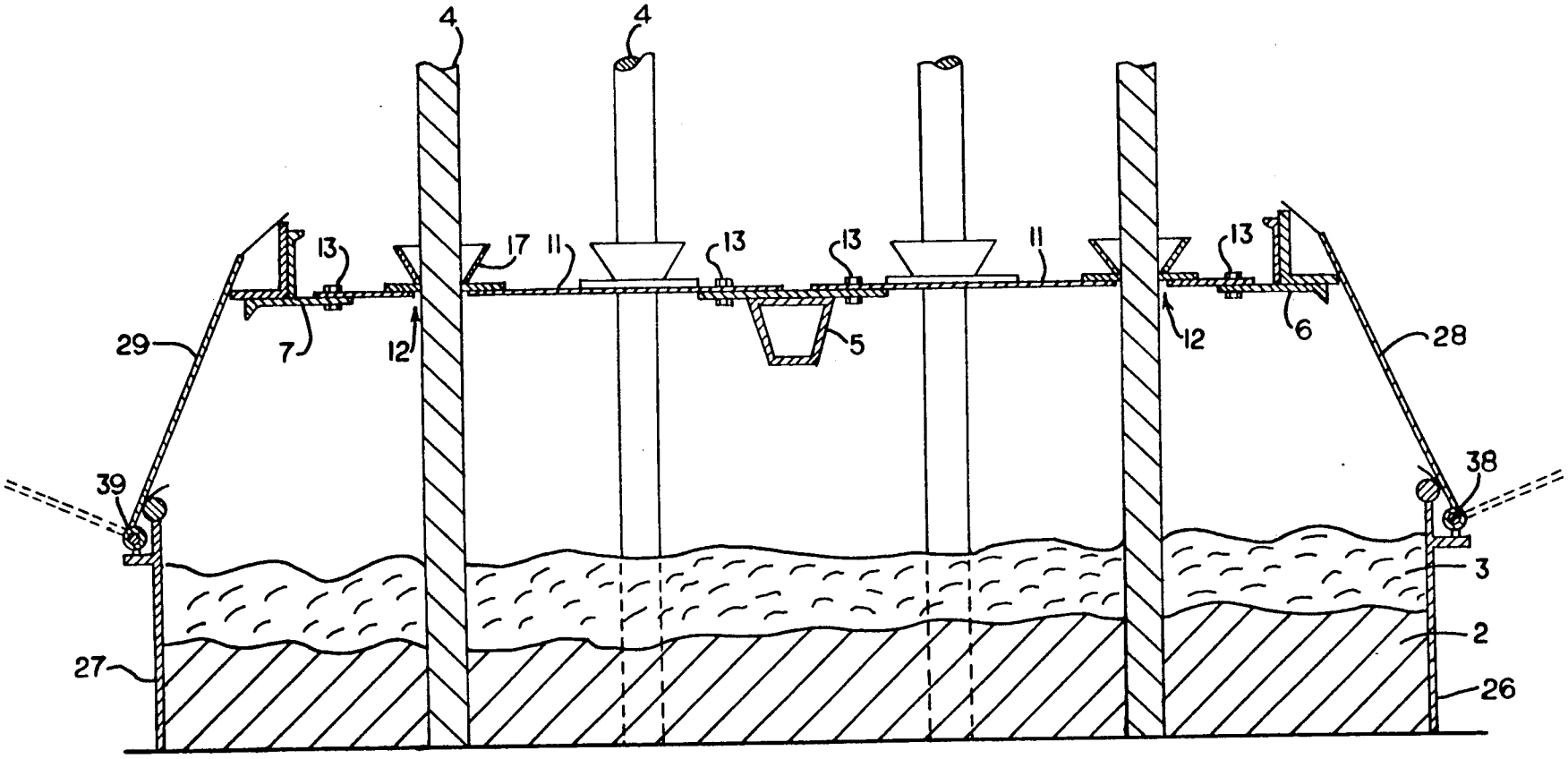
Figure 4:
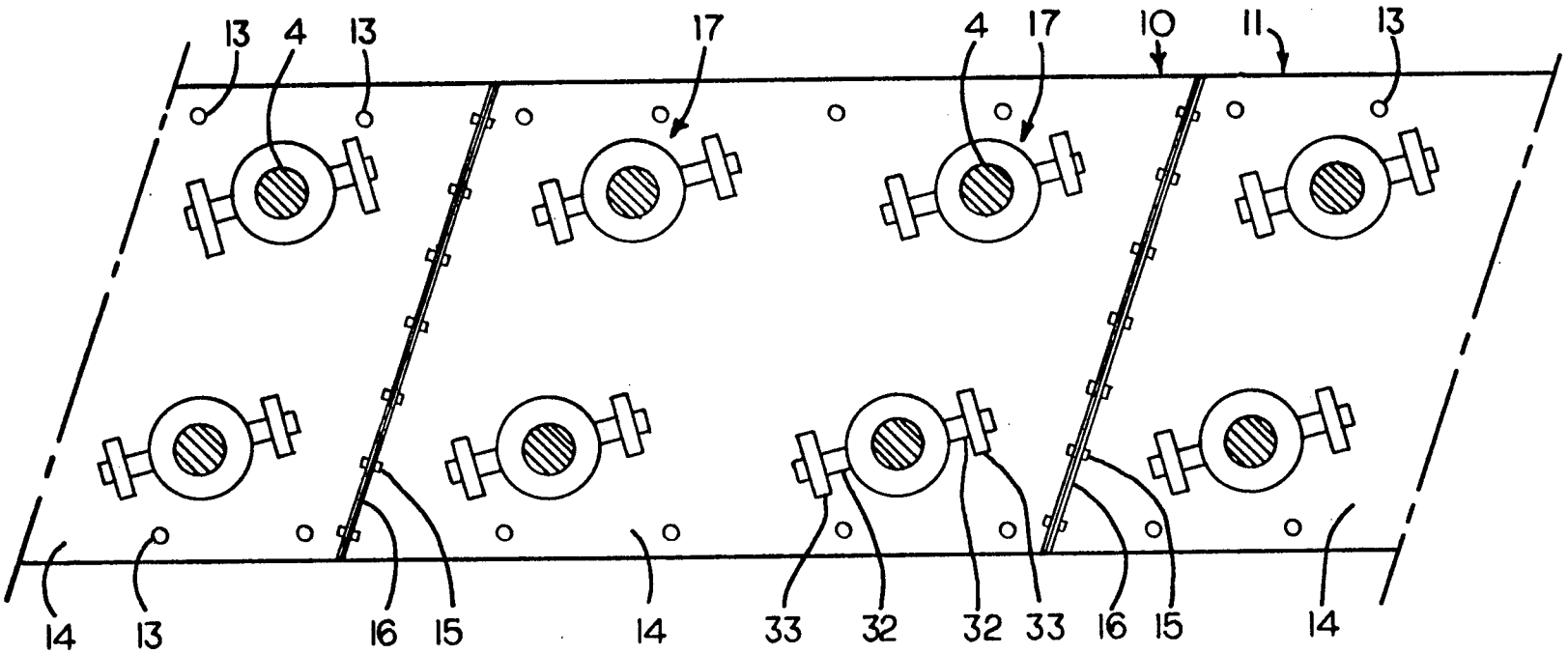
Figure 5:
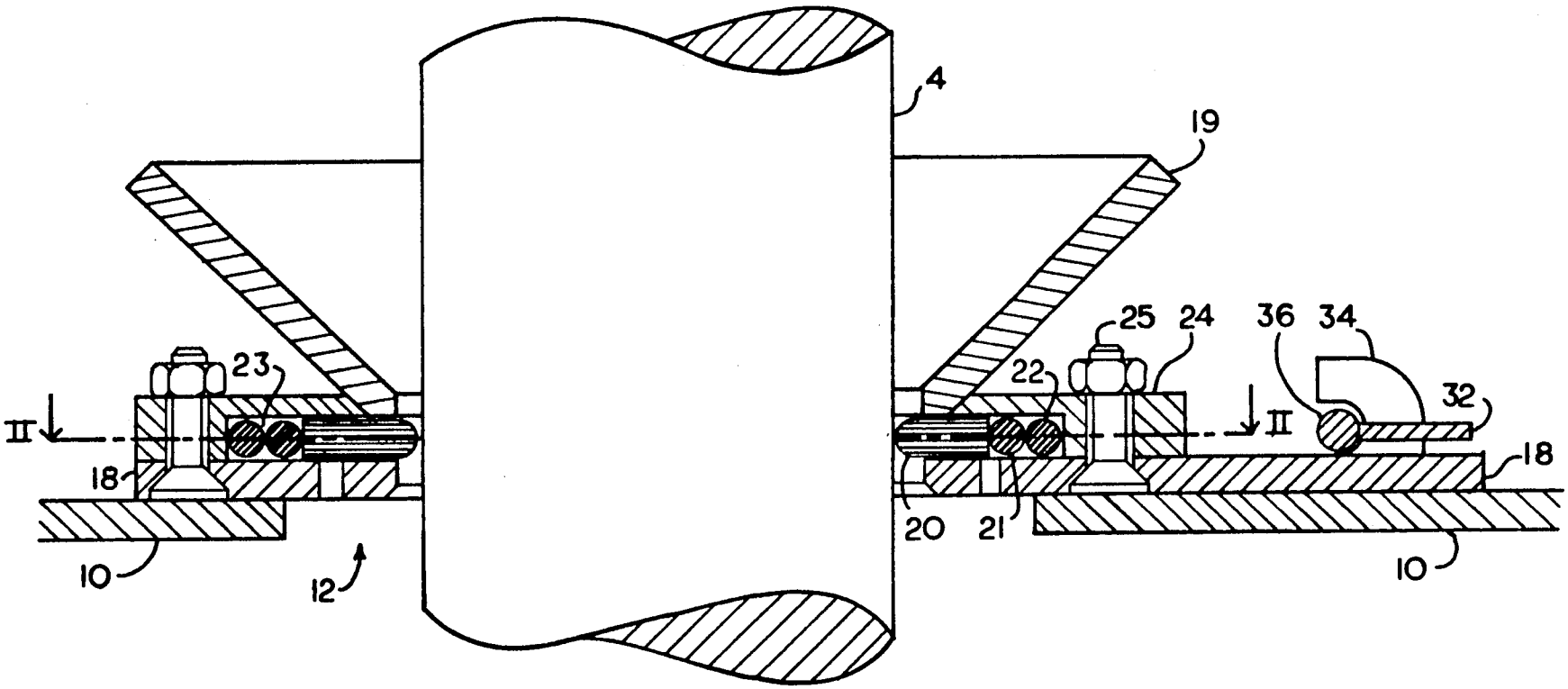
Figure 6:
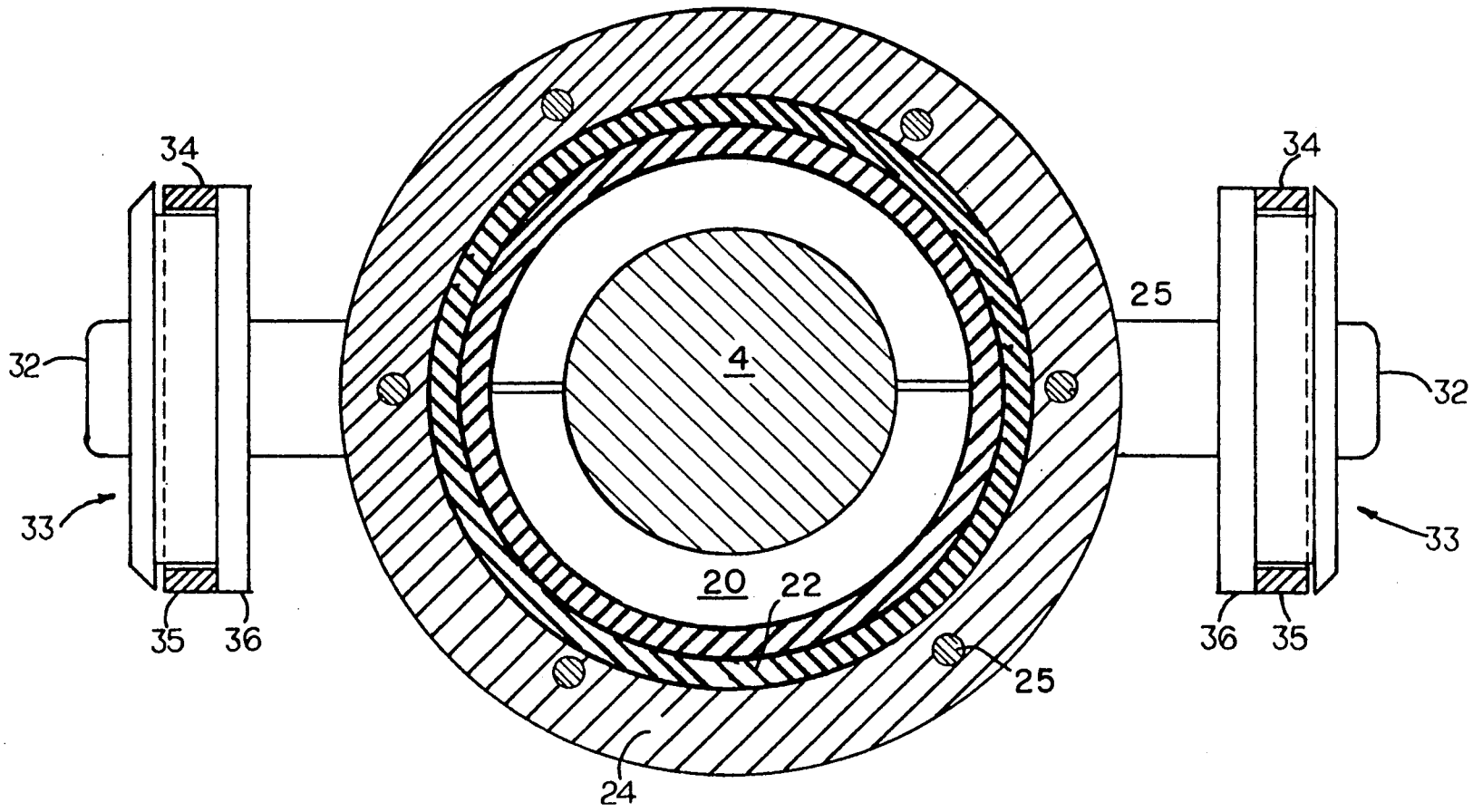

The present invention will now be further described with reference to the accompanying drawings, wherein, FIG. 1 shows a top view of a Søderberganode for electrolytic aluminium cells, FIG. 2 shows a cut taken along line I—I in FIG. 1, FIG. 3 shows another embodiment of the arrangement of FIG. 2, FIG. 4 shows a part of FIG. 1 in enlarged scale, FIG. 5 shows in detail a sealing element of FIG. 2, and where FIG. 6 is a cut taken along line II—II in FIG. 5.

On FIG. 1 and 2 there are shown a Soderberganode for electrolytic cells for production of aluminium. The anode comprises a casing 1 made from iron or steel. Into the anode casing 1 there is charged carbon containing anode paste 3. The carbon containing paste 3 is baked to a solid carbon anode by means of heat which evolves during current supply to the anode and heat from the electrolytic bath. The baked anode is consumed during the electrolytic process. The baked carbon anode is indicated by reference numeral 2 on FIG. 2 and unbaked carbon paste is indicated by reference numeral 3 on FIG. 2 and 3.

The carbon anode is held by a plurality of vertical contact bolts 4 which also serve as current conductors to the anode. As can be seen from FIG. 1 the contact bolts 4 are arranged in four rows in the longitudinal direction of the anode. The contact bolts 4 are suspended from current conducting beams in conventional manner (not shown on the figures).

The arrangement for closing the top of the anode comprises a longitudinal central beam 5 arranged along the longitudinal axis of the anode, and two outer beams 6, 7 arranged on the outside of the rows of contact bolts. The beams 5–7 are suspended upon the short sides 8, 9 of the anode casing. Depending on the length of the anode, the beams are optionally suspended on one or more beams arranged across the anode and resting on the long sides of the anode casing.

Between the central beam 5 and each of the outer beams 6, 7, there are arranged central covers 10, 11 having openings 12 for the contact bolts 4, which openings have a diameter exceeding the diameter of the contact bolts 4. The covers 10, 11 are preferably connected to the central beam 5 and the outer beams 6, 7 by means of screw connections 13.

As shown on FIG. 4 each of the center covers 10, 11 are divided into a plurality of sections 14, each section having openings 12 for four contact bolts 4. The sections 14 are connected to each other by means of screw connections 15 through flanges 16. By this way of splitting the center covers 10, 11, each section 14 of the center covers 10, 11 can easily be replaced by withdrawing the four contact bolts 4 whereafter the section 14 is removed and a new one is installed. This can be done without substantial disturbance of the cell operation. It should be mentioned that it is within the present invention to split the center covers 10, 11 in such a way that each section 14 for example has two or six openings 12 for contact bolts 4.

The annular gap between the contact bolts 4 and the openings 12 in the center covers 10, 11 are sealed by means of sealing elements 17 as shown on FIGS. 2, 3 and 4. The sealing elements 17 are tightly arranged about each of the contact bolts 4 and are floating freely upon the center covers 10, 11. The sealing elements 17 will thus follow any horizontal movement of the contact bolts 4. As can be seen from FIG. 5 each sealing element 17 is equipped with a sealing ring 18 which seals against the center covers 10, 11. In order to enter the contact bolts into the sealing elements, the sealing elements are equipped with an upwardly and outwardly extending cone 19. When the contact bolts 4 have been moved down through the sealing element and into the anode 2, the direction of movement of the contact bolts 4 will be downwards and thereby the contact bolts 4 will ensure that the sealing ring 18 of the sealing elements always will be pressed against the upper surface of the center covers 10, 11.

The sealing against the circumference of the contact bolts 4 is as shown on FIGS. 5 and 6, done by means of a ringshaped member 20, which are pressed against the contact bolts 4 by means of one or two elastic rings 21, 22 contained in a chamber 23 formed by a ringshaped part 24 connected to the sealing ring 18 of the sealing element 17 by means of screw-connections 25. As shown on FIG. 6, the ring-shaped member 20 is made from two parts in order to ensure that the ringshaped part 20 can be pressed into a contact against the circumference of the contact bolts. Between the outer beams 6, 7 and the long sides 26, 27 of the anode casing 1, there are arranged rotatable side covers 28, 29. According to the embodiment shown on FIG. 2 the side covers 28, 29 are suspended by pipes 30, 31 rotatably connected along the outer beams 6, 7. The side covers 28, 29 can thereby be moved from a closed position showed by filled lines on FIG. 2 to an open position shown by dotted lines on FIG. 2. When the side covers 28, 29 are in open positions anode paste can be charged to the top of the anode and the top of the anode can be inspected visually. In order to ensure a good sealing between the pipes 30, 31 and the outer beams 6, 7, there are preferably arranged flexible sealing sheets 40, 41 along the pipes 30, 31. These sealing sheets ensure a good sealing between the outer beams 6, 7 and the pipes 30, 31 when the side covers 28, 29 are in closed positions.

According to the embodiment shown on FIG. 3, the side covers 28, 29 are suspended from pipes 38, 39 rotatably arranged along the sidewalls of the anode casing. The side covers 28, 29 can thereby be moved from a closed position shown by the filled lines on FIG. 3 to an open position shown by dotted lines on FIG. 3. This embodiment has the advantage that any spill of anode paste will be gathered on the side covers 28, 29 and charged to the anode top when the side covers are closed.

In order to prevent the sealing elements 17 from being lifted upwards when the contact bolts are withdrawn from the anode, the sealing elements 17 are, as shown on FIG. 4–6, preferably equipped with one or two horizontal arms 32 engaged into a means 33 comprising two brackets 34, 35 which hold a releasable bolt 36. As can be seen the sealing elements 17 will still be free to move horizontally, but will remain in contact with the top of the center covers 10, 11 when the contact bolts are moved upwardly.

In order to collect the gases which evolve during baking of the anode paste, there is arranged at least one gas outlet 37 in the center covers 10, 11. The off-gas can thereby be gathered and sucked off from the top of the anode and forwarded to a gas cleaning unit (not shown) before the gas is let out to the atmosphere.

What is claimed:

1. Arrangement for closing the top of a Søderberganode used in connection with electrolytic production of aluminium which anode is equipped with an anode casing and vertical contact bolts for holding and for conducting operation current to the anode and where the top of the anode casing is closed by means of at least one cover having openings for the contact bolts and at least one opening for charging anode paste and at least one off-gas opening, characterized in that the cover comprises a central cover having openings for the contact bolts said openings having a diameter exceeding the diameter of the contact bolts and where the annular opening between each of the contact bolts and the corresponding openings in the central cover are sealed by means of sealing elements which are gas tight sealed against each of the contact bolts and which are freely floating on the central cover, and that side covers are arranged between the central cover and the sidewalls of the anode casing, said side covers being rotatably arranged.

2. Arrangement according to claim 1, characterized in that the covers are arranged on three beams longitudinally arranged upon the top of the anode casing, one of the beams being arranged in the center of the anode and the two other beams being arranged on each side of the central beam outside the contact bolts.

3. Arrangement according to claim 2, characterized in that the central cover is affixed to the central beam and to the outer beams by means of screw or bolt connections.

4. Arrangement according to claim 2, characterized in that the side covers are rotatably connected to pipes arranged along the outer beams.

5. Arrangement according to claim 2, characterized in that the side covers are rotatably connected to pipes arranged along the longitudinal sidewalls of the anode casing.

6. Arrangement according to claim 1, characterized in that the central cover is split into a plurality of sections each section comprising openings for at least two, preferably four contact bolts.

7. Arrangement according to claim 6, characterized in that the cover sections are connected to each other by means of bolts through flanges arranged on each section.

8. Arrangement according to claim 1, characterized in that the sealing element comprises a sealing member intended to be pressed against the circumference of the contact bolts by means of one or more elastic members.

9. Arrangement according to claim 1, characterized in that the sealing elements comprises a cone which widens out upwards and outwards.

10. Arrangement according to claim 1, characterized in that the sealing elements comprises a horizontal arm engaged in a holding member in order to prevent the sealing elements from being lifted from the central cover when the anode bolts are withdrawn.

* * * * *